US011439876B1

(12) United States Patent
Sasamoto et al.

(10) Patent No.: US 11,439,876 B1
(45) Date of Patent: Sep. 13, 2022

(54) GOLF CLUB HEAD

(71) Applicant: ADVANCED INTERNATIONAL MULTITECH CO., LTD., Kaohsiung (TW)

(72) Inventors: Akinori Sasamoto, Tokyo (JP); Ming Fu Su, Kaohsiung (TW); Chun-Hao Huang, Kaohsiung (TW)

(73) Assignee: ADVANCED INTERNATIONAL MULTITECH CO., LTD., Kaohsiung (TW)

( * ) Notice: Subject to any disclaimer, the term of this patent is extended or adjusted under 35 U.S.C. 154(b) by 0 days.

(21) Appl. No.: 17/490,814

(22) Filed: Sep. 30, 2021

(30) Foreign Application Priority Data

May 5, 2021 (TW) ..... 110116248

(51) Int. Cl.
*A63B 53/04* (2015.01)

(52) U.S. Cl.
CPC ..... *A63B 53/0437* (2020.08)

(58) Field of Classification Search
CPC ..... A63B 53/0437
See application file for complete search history.

(56) References Cited

U.S. PATENT DOCUMENTS 6,435,980 B1 * 8/2002 Reyes ..... B29C 70/342 428/323
6,623,378 B2 * 9/2003 Beach ..... A63B 53/0466 473/345
6,875,126 B2 * 4/2005 Yabu ..... A63B 53/0466 473/305
6,955,612 B2 * 10/2005 Lu ..... A63B 53/0466 473/409
6,969,326 B2 * 11/2005 De Shiell ..... A63B 53/0466 273/DIG. 7
7,214,142 B2 * 5/2007 Meyer ..... G01N 29/045 473/332
7,699,719 B2 * 4/2010 Sugimoto ..... A63B 53/0466 473/345
8,096,896 B2 * 1/2012 De Schiell ..... A63B 53/0466 473/347
8,147,354 B2 * 4/2012 Hartwell ..... A63B 53/0466 473/344
8,287,402 B2 * 10/2012 De Shiell ..... A63B 53/0466 473/347
8,961,335 B2 * 2/2015 Sugimoto ..... A63B 53/0466 473/332
9,868,036 B1 * 1/2018 Kleinert ..... A63B 53/06
10,583,334 B2 * 3/2020 Martens ..... A63B 53/0433
(Continued)

*Primary Examiner* — William M Pierce
(74) *Attorney, Agent, or Firm* — Muncy, Geissler, Olds & Lowe, P C.

(57) ABSTRACT

A golf club head includes a club head main body and a crown. The club head main body includes a main portion, and a receiving portion connected to the main portion. The main portion has an outer shell surface, and an upright side wall surface interconnecting the outer shell surface and the receiving portion. The crown includes a covering portion, and a protrusion protruding upwardly from an outer periphery of the covering portion, adjoining the side wall surface, and having a to-be-ground surface flushing with the outer shell surface. A height difference between the protrusion and the covering portion prevents the covering portion from being ground.

8 Claims, 5 Drawing Sheets

(56) References Cited

U.S. PATENT DOCUMENTS

| | | | | |
|---|---|---|---|---|
| 10,729,946 | B2 * | 8/2020 | Aramaki | A63B 53/0466 |
| 11,077,340 | B2 * | 8/2021 | Martens | A63B 53/0408 |
| 2018/0189758 | A1 * | 7/2018 | Beach | A63B 53/04 |
| 2019/0015713 | A1 * | 1/2019 | Kato | A63B 53/0466 |
| 2019/0224538 | A1 * | 7/2019 | Spackman | A63B 53/0466 |
| 2019/0290974 | A1 * | 9/2019 | Aramaki | A63B 53/0466 |
| 2019/0290975 | A1 * | 9/2019 | Aramaki | A63B 53/0466 |
| 2019/0308079 | A1 * | 10/2019 | Larson | A63B 60/002 |
| 2019/0314690 | A1 * | 10/2019 | Schweigert | A63B 53/04 |
| 2020/0122003 | A1 * | 4/2020 | Milleman | A63B 53/0475 |
| 2020/0346080 | A1 * | 11/2020 | Schweigert | A63B 53/0437 |
| 2021/0197040 | A1 * | 7/2021 | Parsons | A63B 53/0466 |
| 2021/0268345 | A1 * | 9/2021 | Aramaki | A63B 53/042 |

* cited by examiner

GOLF CLUB HEAD

CROSS-REFERENCE TO RELATED APPLICATION

This application claims priority of Taiwanese Patent Application No. 110116248, filed on May 5, 2021.

FIELD

The disclosure relates to a ball equipment, more particularly to a gold club head.

BACKGROUND

Referring to FIG. 1, a conventional golf club main body 31 of a golf club has an adhering portion 311 to be joined with a crown 32. In a case that a carbon fiber reinforced polymer material is used to make the crown 32, the adhering portion 311 is often designed to be stepped-shaped. Specifically, the club head main body 31 has a peripheral portion being bent to form a stepped structure that has a surface 312 on which the crown 32 is disposed fixedly. To ensure that an outer surface of the crown 32 can be flush with an upper surface of the club head main body 31, a thickness of a portion of the crown 32 corresponding in position to the adhering portion 311 is often increased. As a result, when the crown 32 is adhered to the surface 312, the outer surface of the crown 32 is more prominent than the upper surface of the club head main body 31. As such, the outer surface of the crown 32 is ground to be flush with the upper surface of the club head main body 31.

However, since there is no indication for a to-be-ground region of the outer surface of the crown 32, it is likely to grind regions other than the to-be-ground region of the outer surface of the crown 32 and thus the appearance of the texture of carbon fiber on the outer surface of the crown 32 may be damaged. To ensure integrity of the appearance of the golf club, the outer surface of the crown 32 damaged by grounding is coated with a layer of paint. As a result, an exposed area of carbon fiber of the crown 32 is decreased, which adversely affects the aesthetic quality of the golf club.

SUMMARY

Therefore, an object of the disclosure is to provide a golf club head that can alleviate at least the drawback of the prior art.

According to an aspect of the disclosure, a golf club head includes a club head main body and a crown. The club head main body includes a main portion defining an inner space therein, and a receiving portion connected to the main portion. The main portion has an outer shell surface facing upwardly, and an upright side wall surface interconnecting the outer shell surface of the main portion and the receiving portion. The receiving portion has a covered surface connected to the side wall surface and facing upwardly. The side wall surface and the covered surface cooperate with each other to define a receiving slot. The crown is disposed fixedly in the receiving slot, encloses the inner space, and is made of a composite material. The crown includes a covering portion that is attached to and disposed on the covered surface, and a protrusion that protrudes upwardly from an outer periphery of the covering portion, that adjoins the side wall surface, and that has a to-be-ground surface facing upwardly and flushing with the outer shell surface of the main portion.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
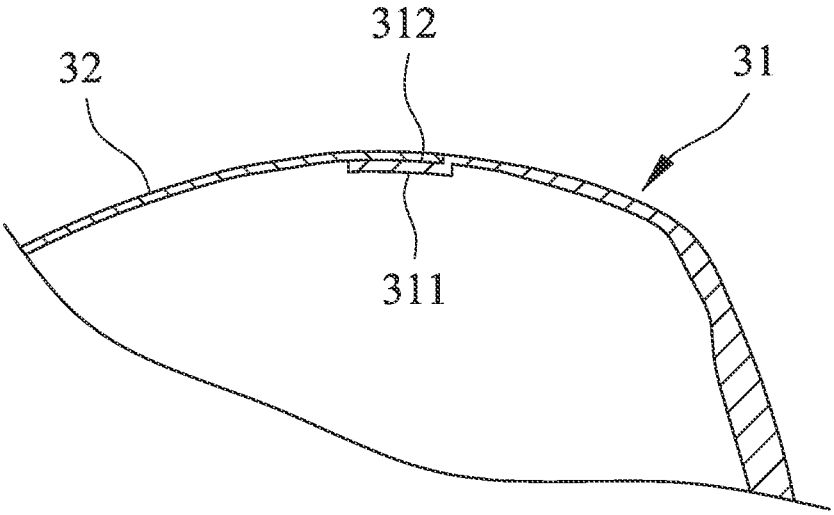
FIG.1 PRIOR ART
FIG. 1 is a fragmentary sectional view illustrating a conventional golf club head.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
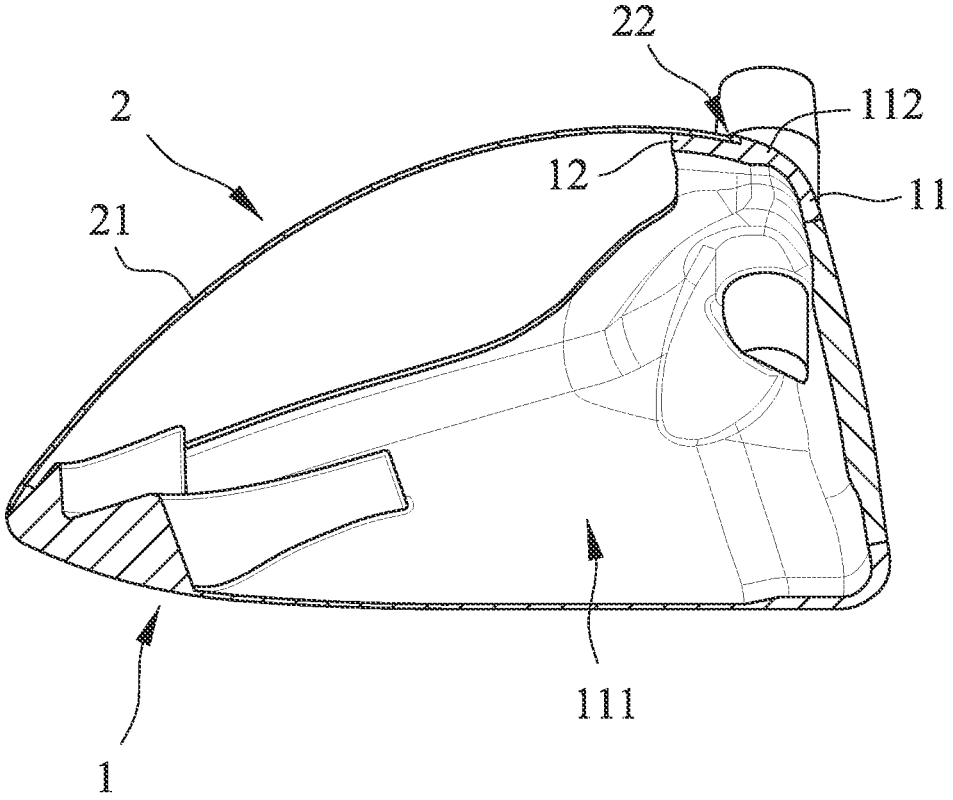
FIG. 2 is a sectional view of a first embodiment of a golf club head according to the present disclosure.
Figure 3:
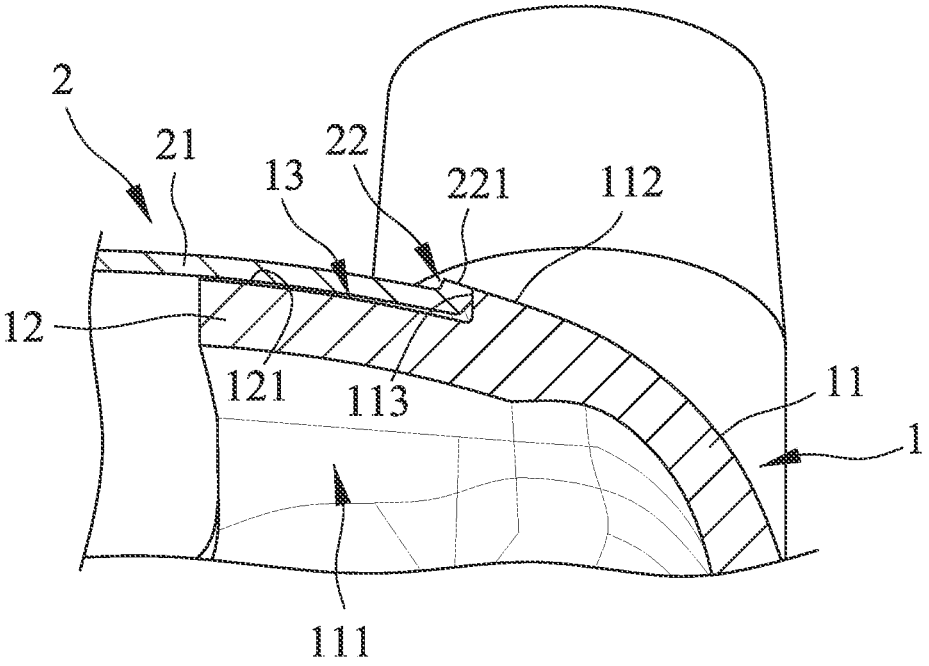
FIG. 3 is a fragmentary sectional view of a portion of the golf club head shown in FIG. 2.
Figure 4:
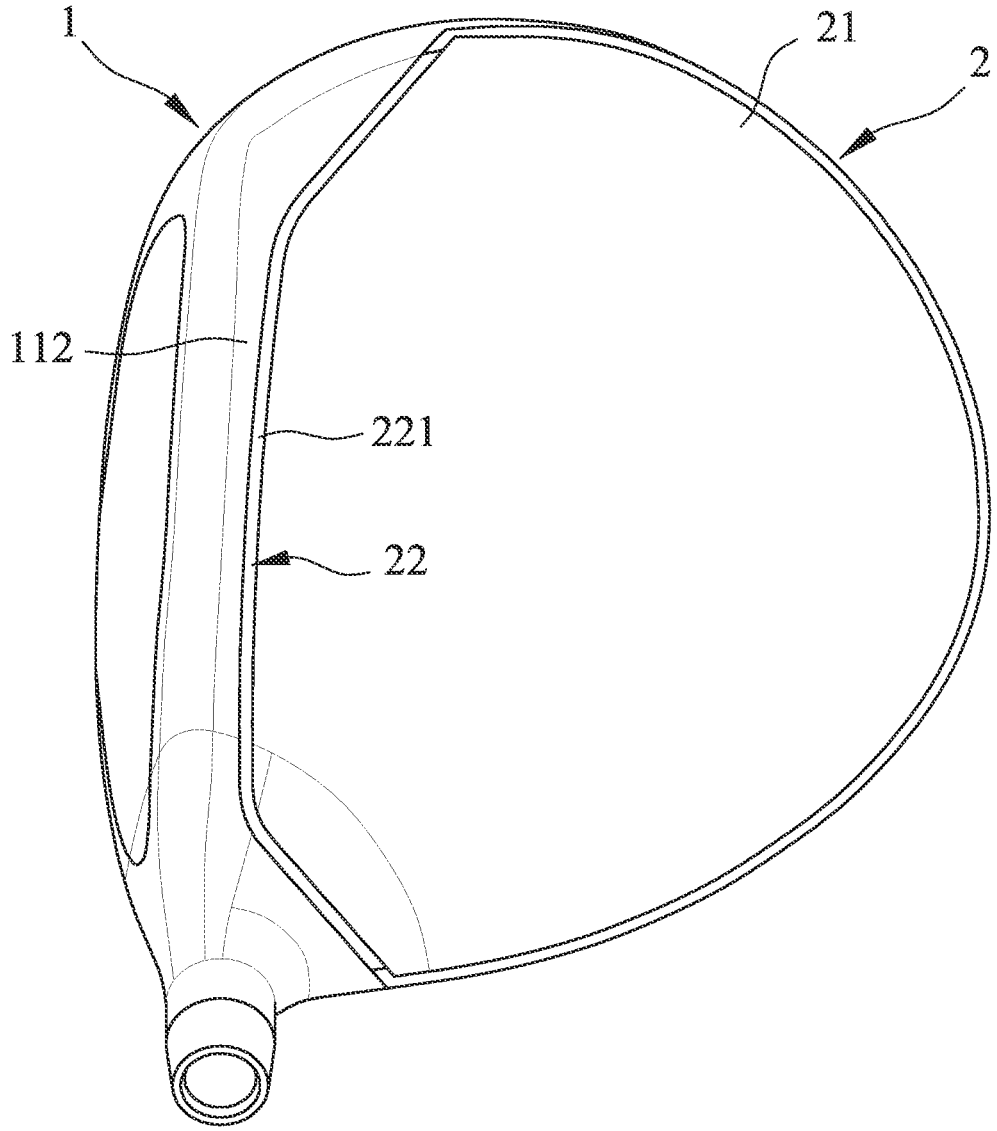
FIG. 4 is a schematic top view of the golf club head shown in FIG. 2.

Referring to FIGS. 2, 3 and 4, a first embodiment of a golf club head according to the present disclosure includes a club head main body 1 and a crown 2 made of a composite material.

The club head main body 1 includes a main portion defining an inner space 111 therein, and a receiving portion 12 connected to the main portion 11. The main portion 11 has an outer shell surface 112 facing upwardly, and an upright side wall surface 113 interconnecting the outer shell surface 112 and the receiving portion 12. The receiving portion 12 has a covered surface 121 connected to the side wall surface 113 and facing upwardly. The side wall surface 113 and the covered surface 121 cooperate with each other to define a receiving slot 13.

The crown 2 is disposed fixedly in the receiving slot 13, encloses the inner space 111, and is made of carbon fiber reinforced polymer or carbon fiber reinforced thermoplastic. A thickness of the crown 2 ranges from 0.4 millimeters (mm) to 0.8 mm. The crown 2 includes a covering portion 21 that is attached to and disposed on the covered surface 121, and a protrusion 22 that protrudes upwardly from an outer periphery of the covering portion 21 to form a stepped structure, and that adjoins the side wall surface 113. In this embodiment, the covered surface 121 of the receiving portion 12 of the club head main body 1 is adhered to and fixed to the covering portion 21 of the crown 2. The protrusion 22 has a to-be-ground surface 221 facing upwardly and flushing with the outer shell surface 112 of the main portion 11. A width of the to-be-ground surface 221 of the protrusion 22 ranges from 0.1 mm to 20.0 mm. A height difference between the covering portion 21 and the to-be-ground surface 221 of the protrusion ranges from 0.05 mm to 6.0 mm. In this embodiment, the to-be-ground surface 221 of the protrusion 22 is a curved surface connected to the outer shell surface 112 of the main portion 11.

To manufacture the golf club head, the protrusion 22 protruding upwardly is ground so that the height difference between the protrusion 22 and the covering portion 21 distinguishes a to-be-ground portion from the remaining portions of the golf club head. In this way, after a grinding process is performed, the covering portion 21 would not be damaged. Thus, a relatively large area of the covering portion 21 can be seen so as to provide a relatively good aesthetic quality.

Additionally, since there is a height difference between the protrusion 22 and the covering portion 21, a protective film such as an aluminum foil can be attached onto the covering portion 21 to prevent the covering portion 21 from being ground and thus damaged.

Figure 5:
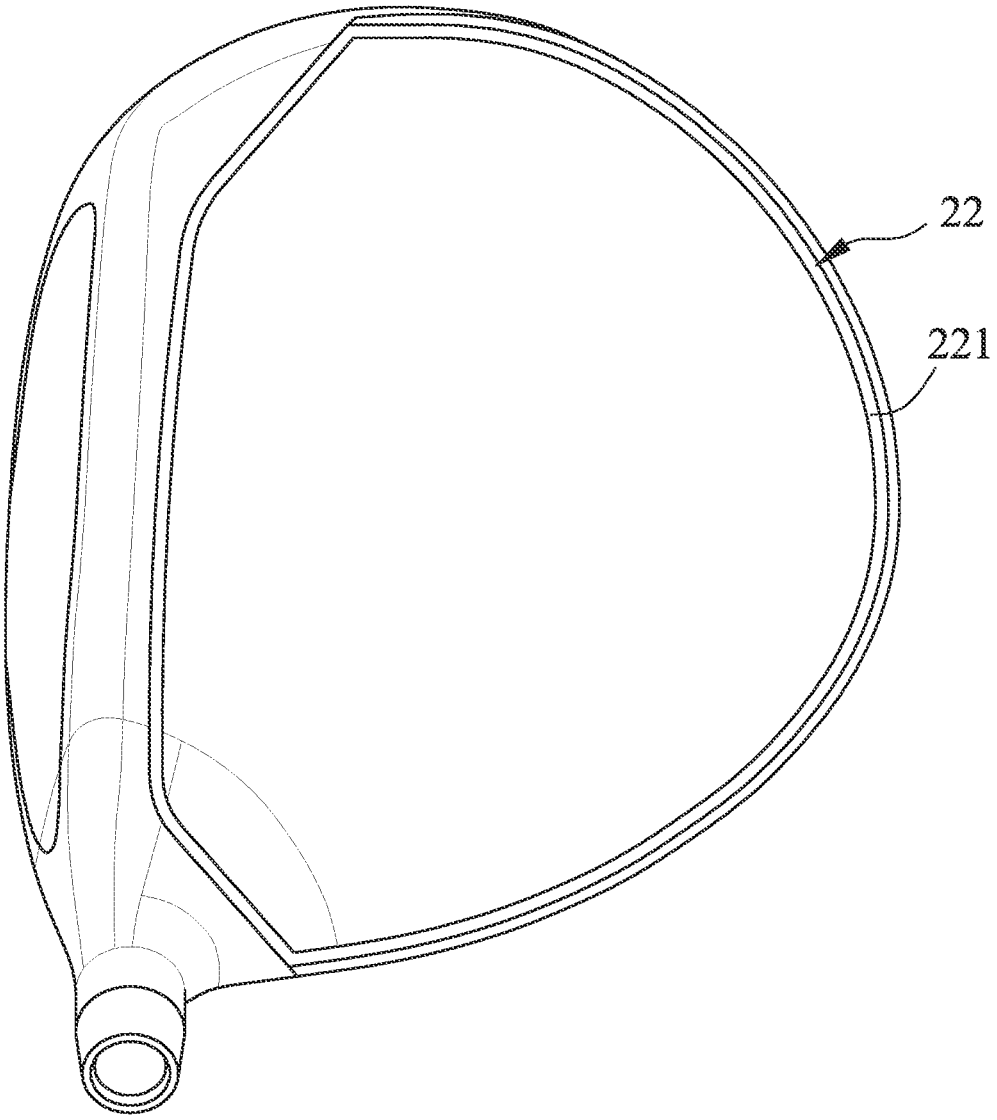
FIG. 5 is a schematic top view of a second embodiment of the golf club head according to the present disclosure.

Referring to FIG. 5, a second embodiment of the golf club head according to the present disclosure is similar to the first embodiment and the difference therebetween resides in the following. In the second embodiment, the to-be-ground surface 221 of the protrusion 22 is a looped surface. The configuration of the to-be-ground surface 221 is changed to provide a different visual effect so that another option of the golf club head having different visual effect can be provided to a user.

To sum up, by virtue of the design of the height difference between the protrusion 22 and the covering portion 21, damage to the covering portion 21 during grinding can be prevented. Thus, a relatively large area of the texture of the composite material making the covering portion 21 is visible so as to provide a relatively good aesthetic quality.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiment but is intended to cover various arrangements included within the spirit and scope of the broadest interpretation so as to encompass all such modifications and equivalent arrangements.

What is claimed is:

1. A golf club head, comprising:

a club head main body including a main portion defining an inner space therein, and a receiving portion connected to said main portion, said main portion having an outer shell surface facing upwardly, and an upright side wall surface interconnecting said outer shell surface of said main portion and said receiving portion, said receiving portion having a covered surface connected to said side wall surface and facing upwardly, said side wall surface and said covered surface cooperating with each other to define a receiving slot; and a crown disposed fixedly in said receiving slot, enclosing said inner space, and being made of a composite material, said crown including a covering portion that is attached to and disposed on said covered surface, and a protrusion that protrudes upwardly from an outer periphery of said covering portion to form a stepped structure, that adjoins said side wall surface, and that has a to-be-ground surface facing upwardly and flushing with said outer shell surface of said main portion.

2. The golf club head as claimed in claim 1, wherein said crown is made of one of carbon fiber reinforced polymer and carbon fiber reinforced thermoplastic.

3. The golf club head as claimed in claim 1, wherein a thickness of said crown ranges from 0.4 mm to 0.8 mm.

4. The golf club head as claimed in claim 1, wherein a height difference between said covering portion and said to-be-ground surface of said protrusion ranges from 0.05 mm to 6.0 mm.

5. The golf club head as claimed in claim 1, wherein a width of said to-be-ground surface of said protrusion ranges from 0.1 mm to 20.0 mm.

6. The golf club head as claimed in claim 1, wherein said to-be-ground surface of said protrusion is a curved surface connected to said outer shell surface of said main portion.

7. The golf club head as claimed in claim 1, wherein said to-be-ground surface of said protrusion is a looped surface.

8. The golf club head as claimed in claim 1, wherein said receiving portion of the club head main body is adhered to and fixed to said covering portion of said crown.

* * * * *